United States Patent [19]

Naso et al.

[11] Patent Number: 4,926,339

[45] Date of Patent: May 15, 1990

[54] COMPUTER AUTOMATED MICROFILM JACKET FEED AND PRINTER DEVICE

[76] Inventors: Michael Naso, 2512 Leslie St.; Frank Naso, 476 Clark Pl., both of Union, N.J. 07083

[21] Appl. No.: 363,470

[22] Filed: Jun. 8, 1989

[51] Int. Cl.[5] ..... G06F 15/20; B41J 13/10

[52] U.S. Cl. ..... 364/478; 271/5; 271/265; 400/582; 400/627

[58] Field of Search ..... 364/478; 400/582, 625, 400/627, 629, 637.1, 639.1; 271/5, 12, 30.1, 102, 208, 259, 265, 2, 3.1, 4, 245, 269, 271, 11, 30, 98, 104, 106, 107; 354/276; 53/520

[56] References Cited

U.S. PATENT DOCUMENTS

| | | | |
|---|---|---|---|
| 2,528,420 | 10/1950 | Carrol et al. | 400/625 |
| 2,996,166 | 8/1961 | Bradshaw et al. | 400/632 |
| 4,160,545 | 7/1979 | Spence-Bate | 271/106 |
| 4,216,953 | 8/1980 | Varady et al. | 271/11 |
| 4,277,190 | 7/1981 | Rudy et al. | 400/582 |
| 4,346,881 | 8/1982 | Frye | 271/208 |
| 4,396,907 | 8/1983 | Shah et al. | 400/625 |
| 4,431,323 | 2/1984 | Kulow | 400/625 |
| 4,473,314 | 9/1984 | Imaizumi | 400/625 |

FOREIGN PATENT DOCUMENTS

| | | |
|---|---|---|
| 0570934 | 12/1957 | Italy . |
| 0033137 | 3/1980 | Japan . |
| 0665513 | 1/1952 | United Kingdom . |

*Primary Examiner*—Joseph Ruggiero

*Attorney, Agent, or Firm*—William T. Hough

[57] ABSTRACT

A computer coordinated microfilm jacket feed and printer machine has a microfilm jacket aligning and feed structure and a microfilm jacket-stacking and aligning platform and elevator thereof. The jacket-feed mechanism positions a forwardly-stacked microfilm jacket in a predetermined pick-up position at which vacuum-oriented pick-up ports of a pivoted pick-up structure suction-attaches a forwardly-advanced feed microfilm jacket, and by the pick-up structure pivoting and injecting the jacket into a printer's platen's input-bite (input-bite position) and guides therefor. The computer activates the platen roller which thus pulls through the microfilm jacket to a print position after turning-off the suction cup's vacuum; the entire machine and computer combination turns-off if the transport mechanism fails to pick-up and transport the printed jacket. The computer causes the printer to print the preprogrammed message or other writing or code onto the microfilm jacket, while concurrently the suction cups are returned to the jacket pickup-position and the suction cups thereupon pick-up the next-occuring jacket, thereafter positioning it at a ready-position for its eventual feed into the intake bite of the printer's platen and guides thereof. A transport mechanism grips and transports the printed jacket to a stacking elevator-controlled stacking tray, when—after printing is completed, the computer causes the printed jacket to eject. Concurrently, during ejection if the printed jacket, the next unprinted jacket is fed into the printer and advanced to a printing position.

27 Claims, 3 Drawing Sheets

COMPUTER AUTOMATED MICROFILM JACKET FEED AND PRINTER DEVICE

This invention is directed to a novel computer automated microfilm jacket pickup, feed, printing and stacking machine.

BACKGROUND TO THE INVENTION

Prior to the present invention, the typing of identity and/or descriptive data or comments or the like onto microfilm jackets has been a tedious and pains taking job, difficult and slow, requiring many work hours of a typist in the picking-up of a single flimsy plastic microfilm jacket from a pile or stack thereof, with difficulty mounting the same evenly within a platen mounting mechanism of a typewriter, followed by repetitive typing-out of the desired message, dismounting the typed microfilm jacket from the typewriter platen, and stacking the same for later insertion of contents, or stopping to make insertion at that time. Such above-noted consecutive procedures are totally disruptive by their very nature, of shifting from one aspect to the other, acceptable speed being virtually impossible. Because of the recent large number of microfilms produced to be placed in identifying microfilm jackets, the task of typing-on the labeling onto such microfilm jackets has required the assigning of numerous person to such tasks, taking these persons out of much more productive and profitable tasks.

Moreover, because of the high amount of static electricity associated with such conventional plastic microfilm jackets, together with their very flimsy and bendable nature, the picking-up, insertion into a printer, the transporting and the stacking thereof, as well as automatically aligned inserting in proper alignment of a transported microfilm jacket into a typewriter or printer platen-guide or platen roller-bite, followed by proper and aligned advancing to a printing position, each and all have provided almost insurmountable problems in efforts to achieve a commercially acceptable and adequately operable automated unit. In fact, it is known that several large corporations have made such attempts, followed by failure and abandonment of the projects.

More particularly, a microfilm jacket is a unitized microfilm designed to accept 16 mm or 35 mm film strips for the purposes of consolidating a short roll film record into fiche format.

The jacket face, by the nature of its design, incorporates various sleeves for film insertion as well as a "header" or "title" area designed to accept written information for the purpose of identifying or commenting on contents of the jacket.

Current methods of titling jackets employ handwriting to a small degree as well as normally typwriting the information thereon. Each of these methods, as above-noted, has proved to be labor intensive, and therefor very expensive from the standpoint of required man hours.

Some alternative current or conventional methods of titling are:

(1) Pressure Sensitive labels: This facilitates use of a computer printer and software. Print speed is a direct result of the speed of the printer being used. The obvious disadvantage to this prior method is the cost of the labels as well as the labor involved in applying them to the jacket title area.

(2) "Tip On" jackets or continuous form: This method employs a technique whereby jackets are glued onto computer printout paper. The forms are then placed through a printer and with the appropriate software, are printed at computer speed. The disadvantages of this method are that these forms typically add 40 percent to 60 percent additional cost to the jacket. Additionally, jackets must be removed from the printout paper once titled. This obviously adds cost to the form of additional labor.

Both of the above mentioned methods do increase speed of titling, but at considerable additional recurring costs.

PRIOR ART

U.S. Pat. No. 2,258,420, granted Oct. 31, 1950 to Carrol et al., discloses a suction cup feeder into a bite of rollers for a mechanical feeder representing an antique attempted solution to the problem of feeding "ledger sheets" into and out of an IBM Bookkeeping Machine. Such system has nothing in common with problems encountered in attempting to automatic pick-up, feed, printing, transport and discharge of microfilm jackets, for reasons stated-above.

U.S. Pat. No. 4,160,545, granted July 7, 1979 to Spence-Bate, utilized several suction cups, requiring use of a plurality of platens, and the claims thereof are directed to solely a single vacuum pickoff. That patent does not at all relate to an overall mechanized nor automated printing machine.

U.S. Pat. No. 4,431,323 granted Feb. 14, 1984 to Kyulow, discloses a mechanism using a bottom feed hopper with a friction wheel pickoff. It also requires use of a specialized platten. It uses platform drive and platform feeder and a drive from a printer, and a lugged belt, a "U" paper guide, integral storage chamber, finger and hooks, platform pivot, and the like, none of which are elements nor equivalents of the present invention. The patent moreover relates to paper envelopes fed from a hopper by a turning friction-feed wheel. The sole far-removed relevance relates to the feeding of an envelope into a typewriter platten.

The U.S. Pat. No. 2,813,612 granted Nov. 19, 1957 to Berglund et al. is directed to a printing press type apparatus with a mechanical sheet-feeder designed particularly for precise registration printing on sheet fed business machines such as a tubulator, etc. Moreover, there is no comparable vacuum system, the disclosed vacuum system relates to a vacuum means as an arcuate portion of a table for separating a leading edge of a single sheet, as merely one side of a pinch-grip system, having no apparent bearing on the present invention.

The U.S. Pat. No. 2,996,166 granted Aug. 15, 1961 to Bradshaw et al., is an "integrated" feeder data system used by Burroughs Corp., used in one of that company's data processing systems, as a mechanical sheet sorting system used to update ledger sheet—having no apparent similarity nor bearing on the present invention.

The U.S. Pat. No. 4,396,307 granted Aug. 2, 1983 to Shah et al. relates to bail control system used to Qume on their printers, for specific feeder design having no apparent relationship to the present invention.

The U.S. Pat. No. 4,473,314 granted Sep. 25, 1984 to Imaizumi employs a horizontal dual bin pivotable stacker, margin portion sensor, tab position sensor, and a read/writer memory—none of which are used by the present invention. The patent was directed to a dual bin feeder design of Brother Printer Manufacturing, and has no teaching relationship to the present invention.

OBJECTS

Accordingly, objects of the present invention include the overcoming and/or avoiding of problems encountered by prior efforts to achieve an automated microfilm jacket feeder, together with the obtaining of a novel automated computer oriented unit functional as a cooperative whole.

More particularly, numerous problems were encountered during the efforts of the present inventors, overcome by the conception and implementing of numerous original innovations directed to overcoming problems associated with shifting of the microfilm jacket during pick-up, and with failure to reliably pick-up the flimsy and highly electrostatic plastic microfilm jacket devoid of altering its orientation, in order to achieve proper and aligned feeding into a printer's platen such that printing would proceed on an aligned and proper basis.

Another object was to avoid jamming and/or mutilation of microfilm jackets being picked-up, transferred, printed, transported and stacked to and from a printer's platten initially from a feed stack eventually to a stack of printed microfilm jackets.

Another object was to obtain single-unit pick-up of microfilm jacket apart from electrostatically attached other dragged microfilm jacket next-occuring in the feed stack.

Another object was to achieve proper feed-out of a printed jacket to stack-properly in a collection unit, electrostatic charge proving to be a substantial problem.

Another object is to allow a typist or word-processor operator or computer operator, to advance type a plurality of consecutive identities and/or messages to be applied to a corresponding plurality of microfilm jackets, in order that the thereby preprogrammed messages may be initiated for the computer to cause the printer to consecutively print-out the consecutive identities, one after the other as the microfilm jackets are consecutively correspondingly fed into the platen mechanism by the combination of the present invention.

Other objects become apparent from the preceding and following disclosure.

Above objects are obtained by the invention as disclosed below.

SUMMARY OF THE INVENTION

Broadly this invention relates to utilization of a conventional type word-processor or computer with its printer, making use of software carrying a program of instruction that is cooperative with the novelly arranged switches and apparatuses for consecutively feeding unprinted microfilm jackets serially into the printer, having the printer print thereon the preprogrammed data, followed by coordinately the printer cranking-out the printed jacket to transport and stacking mechanisms while concurrently feeding in and positioning the next-occuring fed microfilm jacket for its printing, for a long series of serially fed unprinted microfilm jackets and data therefor.

In the disclosure and discussion of this invention herein, as above-noted conventional type software is programmed for use in combination with a conventional word processor or computer. For convenience and simplicity, hereinafter the term "computer" is used to encompass both the computer and/or word-processor hardwardware and the particularly-preprogrammed software thereof such that the coordinated functions described herein are achieved.

Broadly stated, the invention includes improvement(s) in a prior old combination of computer, printer software, and the input guide-structure thereof, resulting in a novel improved combination, as described herein.

In the automated printing device there are included several critical elements in combination, essential for successful and acceptable operation on a commercial level. There is a computer-type mechanism inclusive of computer hardware and software thereof, for receiving and reading, responding to and sending signals responsive to preprogrammed hardware and software in the operating of a printer in combination therewith. The printer is a printer mechanism for printing out data stored on software carried by the computer-type mechanism. While all of the foregoing and following elements are critical, the improvement in this critical combination provides that the printer mechanism includes a platen typing-surface adapted to support flexible substrate to be printed-on by the printer mechanism. The printer mechanism further includes a platen-roller having a longitudinal axis around which the platen-roller is revolvable and carrying the platen typing-surface circumferentially thereon. Also there is a platen-roller line-feed drive mechanism for advancing predetermined line-feed numbers of spaces responsive to programmed signals from the computer hardware and/or the software of/from the computer-type mechanism. Also there are printer support structure and guide structure positioned and adapted to receive and guide flexible substrate during advancement thereof, the guide structure and the platen-roller forming a grasping-bite position therebetween. The support structure and said guide structure is positioned and arranged at a predetermined downwardly-inclined angle of incidence such that a leading upper edge of a microfilm jacket is feedable along an imaginary aligned perpendicular to the grasping-bite position; the grasping bite position extends along a longitudinal axis of the platen roller located between the guide structure and the platen-roller; as a result of this relationship, the flexible substrate is gripable and advanceable by the platen typing-surface when the platen roller by a computer signal from the computer-type mechanism is caused to revolve intermittently in accordance with programming of computer hardware and the software in an advancing direction. The computer-type mechanism is additionally for moving the flexible substrate toward, to and away from a typing state to an ejected state responsive to computer line-feed signal instructions. Also there is included a microfilm jacket-feed mechanism for stacking a plurality of microfilm jackets resting on downwardly-directed top-edges thereof and for advancing the stack of plurality of microfilm jackets toward and feeding intermittently sequentially one-at-a-time a most forward one of said plurality toward and into said grasping-bite position between said guide structure and said platen-roller. The microfilm jacket-feed mechanism includes an elongated support tray elongated along a tray longitudinal axis. Also there is included a take-off jacket-feed mechanism including take-off structure forming an open-end feed-location positioned in an advanced position relative to said support tray. Support-tray side-guides of the take-off structure extend substantially parallel to the tray longitudinal axis providing support for and facilitating advancing of the plurality when the plurality is resting thereon. The microfilm jacket feed-mechanisms further includes a feed-jacket stack-backing mechanism for advancing the plurality toward the open-end feed location. The take-off structure includes at-least two spaced-apart rollable elongated cylindrically-shaped members spaced-apart from one-another extending across the open end transversely to the tray longitudinal axis. The take-off jacket-feed mechanism includes at-least one suction mechanism that includes a vacuum-producing mechanism for alternately providing vacuum and terminating vacuum and for providing a vacuum intake structure and vacuuming opening formed thereby through which vacuum acts. Movement of the vacuum intake structure to and from a vacuuming positionable between said two spaced-apart rollable elongated cylindrically-shaped members at said open-end feed location is controlled by the microfilm jacket feed-mechanism responsive to signals from the computer-type mechanism such that the vacuum-intake structure and vacuuming opening thereof is vacuum-graspable of a substantially flat face of a most forwardly-advanced one of the plurality at said open-end feed location along the tray longitudinal axis. The suction mechanism further includes feed-transport mechanism for moving the vacuum intake structure and a microfilm jacket vacuum-attached thereto to the grasping-bite position with the top edge of a vacuum-attached microfilm jacket having its upper end directed downwardly such that the jacket's longitudinal axis extends perpendicularly relative to the longitudinal axis of the platten-roller at the grasping-bite position.

In each and every one of the following preferred embodiments, the additional elements recited have by experimentation been found to be critical and essential in order to obtain that preferred results of the particular preferred combination.

Accordingly, preferably there are included the above-noted plurality of microfilm jackets, with the microfilm jackets having the downwardly-directed top edges arranged as a stack of the plurality resting on the elongated support tray; the microfilm jackets each have opposite substantially flat forward and rearward jacket-faces and opposite side-edges with each microfilm jacket having a transverse axis between the opposite edges extending substantially between the support-tray side-guides. Opposite ones of the support-tray side-guides are positioned at opposite ends of the transverse axis beside and supporting and guiding the side-edges such that the forward faces of the microfilm jackets are advanceable forwardly along the tray longitudinal axis by rearward pressure thereon by the feed-jacket stack-backing mechanism.

In another preferred embodiment, the stack of feed jackets in the unprinted state, is positioned with the substantially flat forward jacket-faces facing forwardly with the flat forward jacket-faces being substantially transverse to the tray longitudinal axis.

In another preferred embodiment, the take-off jacket-feed mechanism further includes pivotable structure, with the vacuum-intake structure mounted on and transported by movement of the pivotable structure to and from and between said open-end feed location and said grasping-bite position. The pivotable structure in this preferred embodiment is driven in its movement by the feed-transport mechanism.

In another preferred embodiment, the pivotable structure includes a first pneumatic cylinder pivotally mounted on said printer and having an extendable and retractable first shaft thereof having a first shaft distal end. In this preferred embodiment, the vacuum-intake structure being mounted on the first shaft distal end with the vacuum-intake structure positioned at the open-end feed location when the first shaft is in a retracted state of the first pneumatic cylinder. In this preferred embodiment, the pivotable structure further including a second pneumatic cylinder mounted on the printer and having an extendable and retractable second shaft thereof having a second shaft distal end mounting the pivot structure and adapted to pivot the first pneumatic cylinder mounted thereon such that at-least one of extension and retraction of the second shaft by the second pneumatic cylinder is movable of said vacuum-intake structure alternately away to or away-from the open-end feed location, when the second shaft is positioned such that the vacuum-intake structure is away-from the open-end location. In this preferred embodiment, the first pneumatic cylinder is alternately extendable of the first shaft such that the vacuum-intake structure is movable to said grasping-bite position and retractable of the first shaft such that the vacuum-intake structure is withdrawn away-from the grasping-bite position.

In another preferred embodiment, there is included a first switch mechanism for detecting completed movement of the vacuum-intake structure away from the open-end feed location by the second pneumatic cylinder and for thereafter sending a first electrical signal to the computer-type mechanism. In this embodiment the computer-type mechanism is adapted to cause the first pneumatic cylinder to extend the first pneumatic shaft sufficiently to move the vacuum-intake structure to the grasping bite when the computer-type mechanism receives the first electrical signal from the first switch mechanism.

In another preferred embodiment, there is included a second switch mechanism for detecting when a microfilm jacket has vacuum-attached to the vacuum-intake structure and for thereafter sending a second electrical signal to the computer-type mechanism, and the computer-type mechanism being adapted to cause the second pneumatic cylinder's second shaft to pivot the first pneumatic cylinder such that the vacuum-intake structure is moved away-from the open-end feed location.

In another preferred embodiment, electrical activation of the first pneumatic cylinder by the computer causes the first shaft to extend, and in which electrical activation of the second pneumatic cylinder causes the second shaft to retract, the pivotable structure includes a first biasing spring biasing the first shaft to a normally retracted position and state, and the pivotable structure includes a second biasing spring biasing the second shaft to a normally extended position at which the vacuum-intake structure is at the open-ended feed location when the first shaft is in a retracted state.

In another preferred embodiment, the first switch is a vacuum switch by which upon attachment of a microfilm jacket to the vacuum-intake structure increase vacuum pull causes the first switch to close electrical circuit to the first electrical signal to the computer-type mechanism.

In another preferred embodiment, the computer-type mechanism is programmed such that after a first predetermined time-lapse after the second switch activates the first pneumatic cylinder to extend the first shaft, the computer-type mechanism turns-off the vacuum-producing mechanism to thereby terminate vacuum to said vacuum-intake structure and opening thereof such that a formerly-attached microfilm jacket is thereby released. In this embodiment, the computer-type mechanism is additionally for thereafter or substantially concurrently sending a platen-roller line-feed signal to the platten-roller line-feed drive mechanism for sufficiently advancing a grasped microfilm jacket to reach a predetermined printing position for the initiation of printing by the printer, and such that after the vacuum-producing mechanism is turned-off or substantially concurrently therewith the computer-type mechanism sends a signal turning-off the first pneumatic cylinder causing spring retraction of the first shaft and thereafter sends a signal turning-off the second pneumatic cylinder causing the second shaft to extend by said second spring by which the vacuum-intake structure is returned to the open-end feed location, and such that after or substantially concurrently with the computer-type mechanism turning-off said second pneumatic cylinder. In this preferred embodiment, the computer-type mechanism substantially concurrently or thereafter turns-on the vacuum-producing mechanism thereby again providing vacuum to the vacuum-intake structure, more preferably turning it on substantially concurrently.

In another preferred embodiment, the computer-type mechanism is programmed such that after a first predetermined time-lapse after the second switch activates the first pneumatic cylinder to extend the first shaft, the computer-type mechanism sends a print-signal to the printer mechanism causing said printer to print-out a predetermined message stored on the computer software, and thereafter sends an ejection signal to the printer mechanism to initiate a line-feed sufficient to eject a printed microfilm jacket by causing a predetermined amount of advancement of the platten-roller.

In another preferred embodiment, there is included a stacking mechanism for stacking printed jackets delivered thereto, and also a jacket transport mechanism for receiving a printed jacket ejected from the printer mechanism and transporting and delivering the transported printed jacket to the stacking mechanism. The jacket transport mechanism and the stacking mechanism are activated prior to said printer mechanism ejecting a printed microfilm jacket to the jacket transport mechanism. The stacking mechanism and the jacket-transport mechanism are mounted on the printer.

In another preferred embodiment, each the microfilm jacket has opposite top and bottom ends with a jacket longitudinal axis extending therebetween, and the two spaced-apart rollable elongated cylindrically-shaped members at the open-end feed location being positioned one above the other such that a forward microfilm jacket pressed thereagainst has the jacket longitudinal axis extending substantially vertical to an imaginary horizontal line.

In another preferred embodiment, the first and second pneumatic cylinders and the pivotable structure are arranged and interconnected such that when the second pneumatic cylinder has moved-away the first pneumatic cylinder to a removed-position, the second pneumatic cylinder's second shaft has a longitudinal axis thereof extending substantially coaxially with the predetermined downwardly-inclined angle of incidence of said support and guide structure of the printer and substantially coaxially with the imaginary aligned perpendicular to the grasping bite position.

In another preferred embodiment, the angle of incidence of the support and guide structure ranges between about 15 and 25 degrees in order to achieve best grasping at the bite-position.

In another preferred embodiment, the tray's upper surface extending along the tray longitudinal axis from a rearward position to a forward position of the tray, extends angularly downwardly at a tray angle of incidence of from about 90 to about 120 degrees, and the stack-backing mechanism includes a weighted member positioned and adapted to press forwardly by gravity feed the plurality of microfilm jackets along the upper surface and along the tray longitudinal axis toward the open-end feed-location.

In another preferred embodiment, the stacking mechanism includes a substantially horizontally-extending platform structure having structure positioned at a delivery level receivable of at-least one microfilm jacket with the longitudinal axis of the microfilm jacket extending substantially parallel to said platform. In this preferred embodiment, the platform structure is below the delivery level from the jacket transport mechanism and is no lower than is possible for a delivered printed jacket to be substantially horizontally receivable. In this embodiment, there is also an elevator mechanism mounting the platform for alternately moving the elevator upwardly to the receiving level and downwardly to an elevator bottom position. The elevator mechanism also provides for intermittently lowering the platform structure a predetermined minor distance below a prior receiving level such that any delivered printed jacket is not blocked by a prior-received printed jacket.

In another preferred embodiment, the elevator mechanism includes an elevator pneumatic cylinder and an elevator piston-shaft thereof, the elevator piston-shaft having a piston-shaft distal end mounting the platform. In this preferred embodiment, when the elevator pneumatic cylinder is activated by pneumatic pressure extending the elevator piston-shaft, the platform is caused to rise to said receiving level. In this embodiment, there also is included a platform switch mechanism detectable of a microfilm jacket delivered at the delivery level, for activating a intermittent release of a predetermined amount of elevator pneumatic pressure sufficiently to lower said platform the predetermined minor distance.

In another preferred embodiment, there is also included a bottom elevator switch mechanism for detecting when the platform reaches its lowest predetermined bottom level and for turning-off the printer and the other elements of the above-noted improvement(s) when the platform reaches the lowest predetermined bottom level.

Whenever above reference is made to mounting on the printer, it is to be understood that the invention obviously includes equivalent mounting on associated other support structure that achieve an equivalent or same mounting support-function.

The invention may be better understood by making reference to the following Figures.

THE FIGURES

All figures are purely diagrammatic and not intended to be exact dimensions but to be merely diagrammatically representative thereof, as described above and in the following detailed description.

Figure 1:
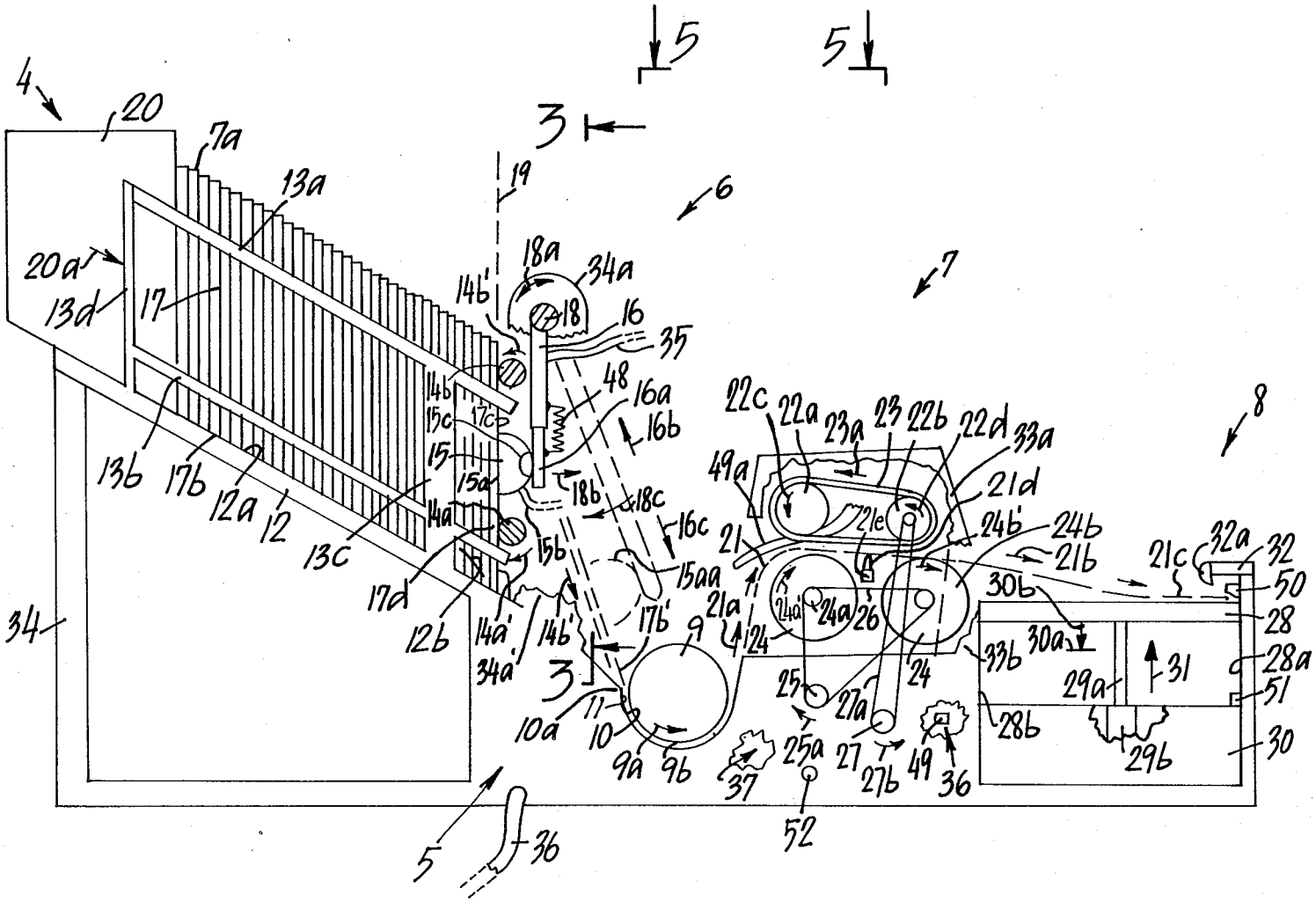
FIG. 1 is a diagrammatic side in-part view with partial cut-aways, illustrating the entire improved combination of this invention.
Figure 3:
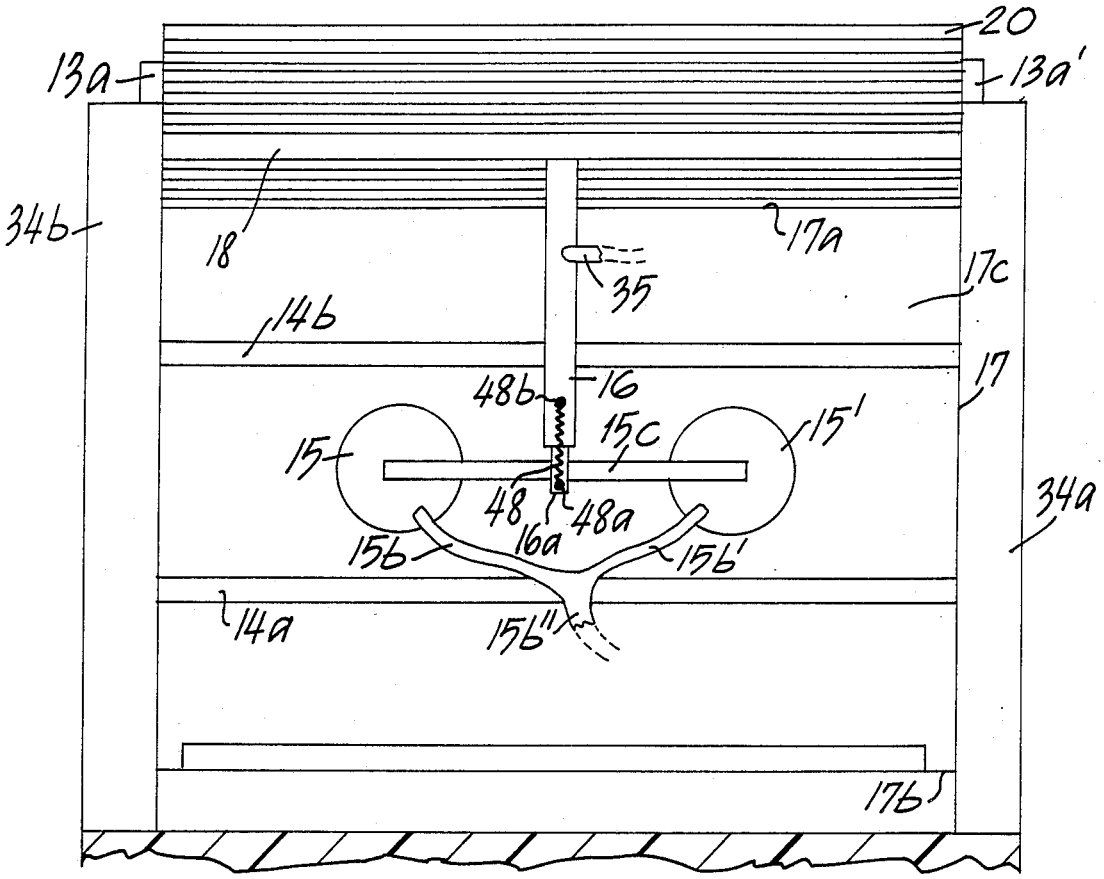

FIG. 3 diagrammatically illustrates an in-part top view with partial cut-aways, as taken along lines 3—3 of FIG. 1.

Figure 4:
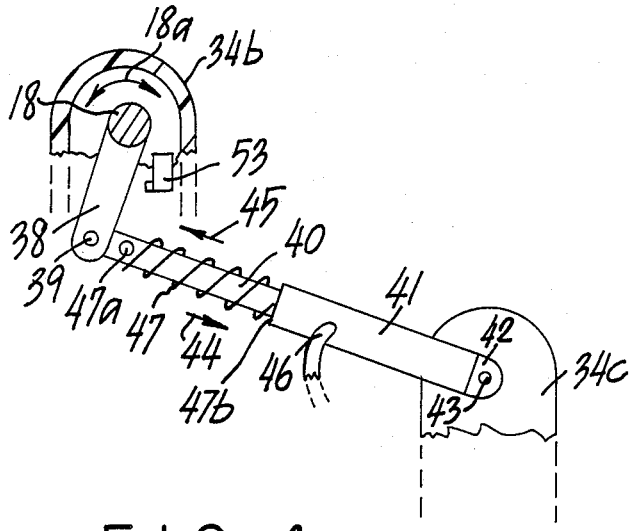

FIG. 4 diagrammatically illustrates the level mechanism and the second pneumatic cylinder and shaft thereof as a part of the combination of mechanism elements utilized in the pivoting in alternate opposite direction of the vacuum-intake structure(s), i.e. suction cups.

Figure 5:
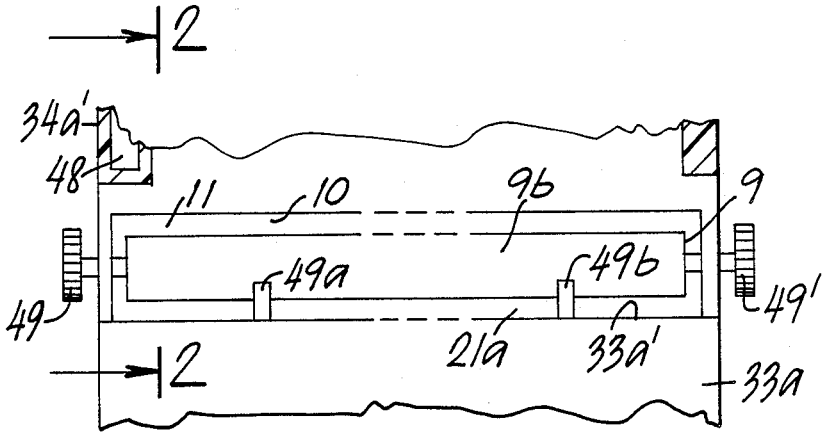

FIG. 5 illustrates diagrammatically an in-part top view as taken along lines 5—5 of FIG. 1.

DETAILED DESCRIPTION

In the following figures, all figures represent a common illustrated embodiment, and accordingly the same indicia are sometimes found in different illustrative figures thereof. For related elements, or elements involved in a common or related function, related indicia are utilized, in order to facilitate understanding. Once an indicia has been described for one figure, description is not repeated except in certain instances to facilitate understanding.

In FIG. 1, the overall improved combination 5 at a cut-away illustrate graphically (diagrammatically) interior conventional printing mechanism(s) 37, and likewise at another cut-away 36 interior computer-type mechanism(s) and computer-software and computer hardware is illustrated; it is to be understood that such computer-type mechanism may or may not optionally include conventional outside other complementary computer-type and/or word-processor type mechanism connected by conventional state-of-the-art cables for input and/or output and/or optionally and normally including desired or conventional in-put keyboard(s) in like conventional manner and types, none of which requires detailed illustration and/or description. The unprinted-jacket feed mechanism 4 feeds the unprinted jackets to the take-off jacket-feed mechanism 6. The take-off jacket-feed mechanism 6 inserts a microfilm jacket into the grasping-bite position 11 between the guide structure surface 10 of guide structure **34*a* and the platen surface 9*b* of the platen 9. After printing, the printed jacket is ejected at position 21*a* to the position 21 against and guided by guide finger(s) such as guide finger 49*a* into the grasp of the jacket transport means 7 which advances the printed to the stacking means 8** at which the printed jackets are stacked one on top of the other.

The elongated tray 12 has downwardly-inclined tray surface **12*a* downwardly-inclined at angle of incidence of angle 12*b* of from about 110 degrees to about 130 degrees, such that the unprinted microfilm jackets stacked one behind the other, slide downwardly on the tray surface 12*a* by gravity as pushed downwardly by weighted member 20 that likewise slides in direction 20*a*. Guides such as guide structure 13*a*, 13*b*, 13*c* and 13*d* maintain alignment of the stack of unprinted microfilm jackets 17. The most forwardly-positioned microfilm jacket of the jackets 17 has its forwardly-facing jacket-rear face 17*c* and rearwardly-facing jacket-front face 17*d*, all of the unprinted jackets 17 being inverted with the jacket-bottom(s) 17*a* at the top side of the stack thereof, and with the jacket-top(s) 17*b* at the bottom side of the stack in contact and slideable along the tray surface 12*a*. The weighted member 20 in its forceful movement and pressing in direction 20*a*, causes the most-forward unprinted jacket's face 17*c* to be pressed against the spaced-apart horizontally-extending rollable or revolvable bars or cylinders 14*a* and 14*b*. When the suction cup(s) 15 and 15' (see FIG. 3) with the forward open suction vent 15*a* thereof is/are positioned against the forwardly-directed jacket-rear face 17*c* when vacuum is turned-on by the computer-type mechanism 38 (and soft and hardware thereof), the cup(s) 15 and 15' attached-to (latched-on to) the jacket-rear face 17*c* at a position between the upper and lower bars 14*a* and 14*b*. Thereafter, when instructed by the computer-type mechanism (pneumatic software and hardware thereof), the suction cup(s) 15 and 15' are moved away in direction 16*b*, thereby pulling the attached-microfilm jacket between the upper and lower bars 14*a* and 14*b* as the bar 14*a* revolves in direction 14*d* and concurrently as the bar 14*b* revolves in direction 14*b'*, noting that in the absence of such revolving, the static electricity existing between the forward jacket and next-occuring jacket therebehind, together with other-drag against the bar(s), causes the jacket to become detached and/or mis-aligned on the cup(s) 15 and/or 15'. After the suction cup(s) have been pivoted to their outer-most position by movement in direction 18, at the outermost position at which the elongated longitudinal axis of the attached microfilm jacket is substantially parallel with and aligned with the guide-surface 10 for insertion into the grasping-bite position 11, thereupon the piston shaft 14*a* of piston 16 is actuated by the computer-type mechanism (and hardware and software thereof) in direction 16*c* to thereby move the attached unprinted jacket into the grasping-bite position by moving the attached-jacket in direction 14*b'* such that the cup 15 (for example) is moved to the phantom-indicated position 15*a* with the phantom-indicated microfilm jacket 17*b'* within the grasping-bite position. The jackets 17, as supported against the bars 14*a* and 14*b*, are supported with the longitudinal axis (axes) thereof in a substantially vertical position along imaginary vertical line 19. After the conventional word-processor and/or computer-type printing when the conventional-type or desired printer is activated by the conventional-type computer (and hardware an/or software thereof) and the following line-feed(s) therefrom by which the printed jacket is ejected in ejection-direction/position 21*a*, the ejected printed jacket is grasped between the outer grasping surfaces of lower roller(s) 24 revolving in direction 24*a'* and upper belt 23 that revolves in direction 23*a* on its mounting rollers (or cylinders) 22*a* and 22*b* in directions 22*c* and 22*d*. The roller(s) 24 are driven to revolve in direction 24*a'* by drive mechanism 25 and its belt 26 on roller members 24*a* and roller(s) 22*a* are driven in direction 22*c* by drive mechanism 27 and its belt 27*a*. In a coordinated revolving speed, the roller 24*b* revolving in direction 24*b'* acts with the belt 23 of coordinated speed to eject printed jackets in position/direction 21*b* to a stacked position or location 21*c*. When enough printed jackets have been stacked one on top of the other at location 21*c* such that the last-stacked thereof strikes the switch-finger (lever) 32*a* of stack-detecting sensor switch 32, by conventional electrical and/or mechanism connections, the cylinder 29*b* is caused to release over a minor predetermined period of time, sufficient pneumatic pressure as to cause the elevator platform 28 to become lowered to a lower typical position 30*a* (a minor distance lower) by partial-retraction of the pneumatic cylinder shaft 29*a* in direction 30*b*, of the elevator mechanism 30. Elevator platform 28 travels within and guided by guide structures symbolically represented as structures 28*a* and 28*b*. Prior to or at the time of activation of the other elements of the overall combination of the invention, the elevator 30 is activated to move the platform 31 in direction 31 to the typically illustrated position at which the platform 28 is spaced a predetermined minor distance below the position/direction 21b of delivery of the jacket being stacked. The support structure 33a, shown in partial cut-away, is continuous with lower-illustrated support structure 33b which is continuous with structure 28b and support structure 34 and support structures 34a' and 34a. The cylinder 16 receives its pneumatic pressure through a feed tube 35 by a pneumatic pressure mechanism that is a part of and controlled by the computer-type mechanism 36. Also symbolically shown in the shaft-retraction spring connected between and biasing to the retracted state the cylinder 16 and its shaft 16a biased in a retracting direction 16b thereby, whenever the pneumatic cylinder 16 is not pneumatically activated by the computer-type mechanism to an extended state along line 16c. As the transported printed jacket passes and touches the feeler finger-lever 21d, jacket-detector switch 21e activates (closes circuit momentarily) to send an electrical signal to the computer-type mechanism (and hardware and software thereof) to prevent the entire combination from automatically shutting-down—lack of such a signal from switch 21e indicating the possible presence of a "jam-up", causing a shut-down if no signal is received within a predetermined time-lapse after the platten line-feed ejects the printed jacket. Switch 21e is rigidly mounted (not shown) on the support structure 33a (either directly or indirectly). When the elevator platform 28 is caused to rise, top-level limit-switch 50 detects the platform when it reaches the top-limit, to turn-off the pneumatic pressure—terminating further rise of the platform 28. In like manner, whenever the platform 28 eventually has been lowered to the maximum lowered position as determined by limit switch 51 which detects the lowered elevator platform 28, the entire improvement combination is shut-down by electrical signal sent to the computer-type mechanism after which the computer-type mechanism immediately activates a shut-down alarm and turns-off all actuating power to the improved combination, to prevent the ejection of further (additional) jackets to the already-filled platform 28. After operator removal of the stack from the platform 28, the operator activates the entire improved combination by a conventional switch thereof, such as button 52**.

Figure 2:
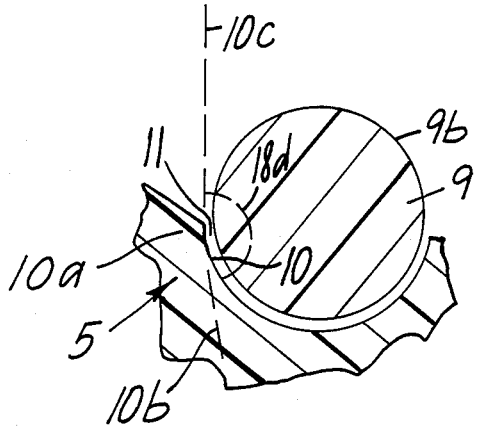
FIG. 2 is a diagrammatic side in-part cross-sectional view taken along lines 2—2 of FIG. 5.

In FIG. 2, in an in-part view the platten 9 and surface 9b thereof and the guide surface 10 and grasping-bite position are shown in enlargement, together with showing the guide surface as a lineally-extending surface extending along an imaginary axis (line) 10b at an angle of incidence 10d that is between about 155 degrees and about 170 degrees from vertex point 10a. When the suction cup(s)-attached jacket is position as afore-stated jacket-position 17b' in the grasping-bite position when the cylinder shaft, 16a is in the extended state along direction/position 14b', the longitudinal (elongated) axis of the microfilm jacket as position 17b' is parallel with and aligned with the imaginary axis/line 10b of linear surface 10.

FIG. 3 illustrates diagrammatically a forward-to-rearward front in-part view of FIG. 1, of the suction cups 15 and 15' mounted on the suction extension 15c that is mounted on shaft 16a. Also, the spring 48 is shown diagrammatically connected between shaft anchoring-member 48a and cylinder anchoring member 48b. Other indicia have been previously described.

FIG. 4 illustrates a remaining portion of the pivot and/or lever mechanism for causing the bar 18 to rotate in alternate directions 18a, such as the moving-away direction 18b and the return direction 18c (returning the cup(s) to the home-position adjacent the most-forward microfilm jacket on the feed-tray surface 12a retained by horizontal bars 14a and 14b. In the alternate movements 18a of bar 18, computer-type 8-activation of pneumatic cylinder 41 by feeding increased pneumatic pressure/air into tube 46, causes the shaft 40 to retract by movement in direction 44, and when not activated, the biasing spring 47 biases the shaft 40 in direction 45 to the extended illustrated state at which the suction cup(s) are positioned as shown in FIG. 1. The cylinder 41 is mounted pivotally on pin 43, and the distal end of the shaft 40 is mounted pivotally by pin 39 on the distal end of lever 38 which is rigidly mounted on the bar 18, such that movement of the lever 38 causes the bar 18 to rotate responsively. The direction 44 corresponds to direction 18b of FIG. 1, and direction 45 corresponds to direction 18c of FIG. 1. Pin 43 is mounted on support structure 34c. The lever and/or pivoting mechanism of FIG. 4 and elements thereof, are mounted within space 49 of FIG. 5. Sensor switch 52 detects that the cylinder 41 has moved the lever 38 to its predetermined limit at which the suction cups have been moved to in the direction 16b spaced-away position.

FIG. 5 diagrammatically illustrates an in-part view of the platten 9 and its surface 9b, the grasping-bite position 11, the linear guide wall 10, the support structure 34a' and space 48 thereof, and other elements and support structure previously described.

Without repeating indicia to the extent above, the typical operation of the improved combination is typically as follows.

Vacuum pressure-sensing switch 27b detects presence of vacuum/reduced pressure—resulting from attachment of a jacket to the suction cup(s) causing an electrical signal (which may be either initiation of an electrical signal, or the termination of an electrical signal) to the computer-type mechanism—signifying the fact that a jacket has been suction-attached to the suction cup(s). When vacuum is turned off (letting pressure rise), the vacumm is turned-off, letting pressure rise (opposite of vacuum). Whenever the vacuum is turned on, for the suction cup(s) mounted on the distal end of the pneumatic cylinder shaft 14a of cylinder 16, when the suction cup grabs (attaches to) the forward flat surface (of rear face) of the microfiche (microfilm) jacket, the computer-type mechanism detects the jacket-attached signal thereupon sent by the switch 27b. The suction cup(s) are at the so-called home-position adjacent and pressing against the next jacket with the cylinder 16 sring-biased by spring 47 (on shaft 40) to the retracted position. Thus, when the vacuum and overall printer 5 and computer-type mechanism 36 are turned-on (activated for operation), if and when a microfiche jacket is properly positioned to be picked-up, the suction cup(s) attach thereto, whereupon the computer-type mechanism receiving the signal from the switch 27b causes the pneumatic cylinder 41 to become pneumatically activated to thereupon thereafter retract its shaft 40 such that the cylinder shaft 40 causes the cylinder 16 to pivot away from the jackets-holder. Thereby the suction cup(s) 15 and 15' and the unprinted microfiche jacket attached thereto are moved away-from the home position. A switch 53 (FIG. 4) detects when the cylinder 16 has pivoted to the spaced-away position relative to the jackets-holder and thereupon the switch 53 sends a signal to the computer-type mechanism notifying the computer-type mechanism of that fact. Thereupon, the computer-type mechanism activates the pneumatic cylinder 16 to pneumatically extend whereupon from its pivoted position the extended shaft 16*a* of the cylinder 16 causes the jacket's downwardly-directed upper end to be pressed or jammed downwardly into the bite of the input grasping-bite position 11 of a printer's platten surface 9*b* and guide linear surface 10. As guaged from the point in time that the cylinder 16 is pneumatically activated to extend shaft 16*a* to the extended position, the computer-type mechanism on a timing-basis, after a predetermined time sufficient for the jacket's upper end to reach the input-bite position of the printer's platen turns-off the vacuum and substantially concurrently or thereafter turns-off pneumatic pressure to pneumatic cylinder 16, and substantially concurrently or thereafter activates the printer's platen-revolving mechanism to cause the platen to revolve a predetermined number of line-feed spaces sufficiently to carry the jacket to a predetermined printing position. After the vacuum has been turned-off by the computer-type mechanism, the computer-type mechanism turns-off the pneumatic pressure to pneumatic cylinder 41 whereby by spring-action of spring 47 the cylinder 41's shaft 40 extend to cause the cylinder 16 to return-pivot to the home-position. Preferably before, or alternately concurrent with or after the suction cup(s) reaching the home position, vacuum is again turned-on and the sequence of picking-up (attaching to) a next-occuring jacket takes place, followed—as before, by the pivoting-away by activation of the cylinder 41. When the computer-type mechanism receives a signal that printing is complete, the computer-type mechanism activates the platen roller to turn up a predetermined number of line-feed spaces, eventually to a nip-release position for releasing the lower-end of the jacket from the output-nip position of the platen such that the upper end of the printed jacket becomes fed into a transport mechanism. During or after the revolving of the platen roller to carry the printed jacket to the output nip-release position, the computer-type mechanism activates the cylinder 16 to cause the next carried jacket to be fed (jammed) into the bite of the platen roller (and guides thereof), such that as the platen 9 turns, during and/or after the ejection of the printed jacket from the output bite position 21*a*, the next unprinted jacket is moved to its predetermined printing position, after which printing is again activated by the computer-type mechanism. When the printed jacket is ejected from its platten output bite and position 21*a* thereof, the upper edge of the printed jacket become simultaneously pressed against and guided-along one or more guide fingers 49*a* or equivalent railings or the like, such that the upper (top-end) edge of the printed jacket is guided into a bite position between take-off transport roller(s) 24*a* and 24*b* and/or belt(s) 23 of the transport mechanism 7, while the revolving platten 9 is ejecting the printed jacket. Before, during or after the printed jacket's upper end reaches the transport intake bite-position 21 of the transport mechanism 7 which preferably run(s) continuously or alternately is/are intermittently activated, the printed jacket is thereby dragged-through the transport mechanism 7 to eject the printed jacket from the output end of the transport mechanism to ejection position/direction from the output end of the transport mechanism to ejection position/direction 21*b* whereupon the ejected jacket becomes stacked at position 21*c* on or above the platform 28. At the time the printed jacket is dragged into the transport mechanism 7, the dragged printed jacket strikes and activates (or otherwise activates) finger 24*d* of sensor switch 21*e* thereby sensing the presence of the printed jacket to inform the computer-type mechanism thereof such that the computer-type mechanism does not shut-off to prevent a jamming-up of jackets or the like.

When after completion of the print-out by the printer, the printed jacket has been fed into the transport mechanism's bite between opposing rollers and conveyor belts, the printed jacket is thereby conveyed to a transport mechanism's output end at a drop-off location at which the printed jacket is pressed onto the top of a stacking tray/platform 28 or on top of a stack of earlier-stacked printed jackets stacked on top of the stacking tray; the tray or platform 28 is a part of a tray elevator unit 8. The elevator unit 8 includes a pneumatically activated and controlled elevator 30, controlled by pneumatic pressure of air input and release valves thereof for raising the elevator platform 28 by air input and for intermittently releasing air to lower the elevator. When compressed air is fed into a conventional elevator air-tube having a conventional closed outlet, the elevator rises to a point of switch-signal activation of switch 50 that breaks electrical circuit to or otherwise turns-off the pneumatic air-pressure source thereby to terminate further rise (raising) of the elevator's stacking tray/platform 28. When a sufficient number of printed jackets have been stacked as to strike a feeler element 32*a* of switch 32, the switch 32 causes an elevator control electrical (or mechanically-controlled) switch to respond to cause the pneumatic outlet to open and almost immediately thereafter close over a short interval sufficient for the elevator to lower a predetermined amount, such that additional jackets may be stacked on top of the existing stack; alternately, the feeler element may directly open a bleed-valve normally spring-bias to a closed state, for the permitting of escape of a measured amount of air (air-pressure) to thereby lower the elevator's stacking tray. When the elevator platform 28 eventually reaches its lower limit switch 51, an alarm signal (of the computer-type mechanism) is activated such that an operator is notified and manually removes the stack and reactivates the elevator to its highest limit preparatory to receiving another stack of printed jackets, typically by the mere pressing of the single button 52.

It is within the scope of this invention to make substitution of equivalents and/or variation(s) thereof within the skill of the ordinary artisan in this art.

We claim:

1. In an automated printing device that includes a combination of a computer-type means inclusive of computer hardware and software thereof, for receiving and reading, responding to and sending signals responsive to preprogrammed hardware and software in the operating of a printer in combination therewith, the printer as a printer means for printing out data stored on software carried by the computer-type means, the improvement providing an automated microfilm jacket improved combination comprising: said printer means including a platen typing-surface adapted to support flexible substrate to be printed-on by said printing means, and a platen-roller having a longitudinal axis around which the platen-roller is revolvable and carrying said platen typing-surface circumferentially thereon, and a platen-roller line-feed drive means for advancing predetermined line-feed numbers of spaces responsive to programmed signals from said hardware and said software from said computer-type means, and printer support structure and guide structure positioned and adapted to receive and guide flexible substrate during advancement thereof, said guide structure and said platen-roller forming a grasping-bite position therebetween, said support structure and said guide structure being positioned and arranged at a predetermined downwardly-inclined angle of incidence such that a leading upper edge of a microfilm jacket is feedable along an imaginary aligned perpendicular to said grasping-bite position extending along a longitudinal axis of the platen roller located between the guide structure and said platen-roller such that said flexible substrate is gripable and advanceable by said platen typing-surface when said platen-roller by a computer signal from the computer-type means is caused to revolve intermittently in accordance with programming of said hardware and said software in an advancing direction, by the computer-type means being additionally for moving the flexible substrate toward, to and away from a typing state to an ejected state responsive to computer line-feed signal instructions; and a microfilm jacket-feed means for stacking a plurality of microfilm jackets resting on downwardly-directed top-edges thereof and for advancing the stack of plurality of microfilm jackets toward and feeding intermittently sequentially one-at-a-time a most forward one of said plurality toward and into said grasping-bite position between said guide structure and said platen-roller, said microfilm jacket-feed means including an elongated support tray elongated along a tray longitudinal axis, a take-off jacket-feed means including take-off structure forming an open-end feed-location positioned in an advanced position relative to said support tray, and support-tray side-guides thereof extending substantially parallel to said tray longitudinal axis providing support for and facilitating advancing said plurality when the plurality is resting thereon, and the microfilm jacket feed-means further including a feed-jacket stack-backing means for advancing said plurality toward said open-end feed location, said take-off structure including at-least two spaced-apart rollable elongated cylindrically-shaped members spaced-apart from one-another extending across said open end transversely to said tray longitudinal axis, and the take-off jacket-feed means including at-least one suction means including a vacuum-producing means for alternately providing vacuum and terminating vacuum and for providing a vacuum intake structure and vacuuming opening formed thereby through which vacuum acts, with movement of the vacuum intake structure to and from a vacuuming positionable between said two spaced-apart rollable elongated cylindrically-shaped members at said open-end feed location being controlled by the microfilm jacket feed-means responsive to signals from said computer-type means such that said vacuum-intake structure and vacuuming opening thereof is vacuum-graspable of a substantially flat face of a most forwardly-advanced one of said plurality at said open-end feed location along said tray longitudinal axis, and the suction means further including feed-transport means for moving said vacuum intake structure and a microfilm jacket vacuum-attached thereto to said grasping-bite position with the top edge of a vacuum-attached microfilm jacket having its upper end directed downwardly such that the jacket's longitudinal axis extends perpendicularly relative to said longitudinal axis of said platten-roller at said grasping-bite position.

2. The improvement of claim 1, including said plurality of microfilm jackets, including the microfilm jackets having said downwardly-directed top edges arranged as a stack of the plurality resting on said elongated support tray, said microfilm jackets each having opposite substantially flat forward and rearward jacket-faces and opposite side-edges with each microfilm jacket having a transverse axis between said opposite edges extending substantially between said support-tray side-guides having opposite ones thereof positioned at opposite ends of said transverse axis beside and supporting said guiding said side-edges such that said forward faces of said microfilm jackets are advanceable forwardly along said tray longitudinal axis by rearward pressure thereon by said feed-jacket stack-backing means.

3. The improvement of claim 2, in which said stack is positioned with said substantially flat forward jacket-faces facing forwardly with the flat forward jacket-faces being substantially transverse to said tray longitudinal axis.

4. The improvement of any one of claim 1, 2 or 3, in which said take-off jacket-feed means further includes pivotable structure, with the vacuum-intake structure mounted on and transported by movement of the pivotable structure to and from said between said open-end feed location and said grasping-bite position, said pivotable structure being driven in its movement by said feed-transport means.

5. The improvement of claim 4, in which said pivotable structure includes a first pneumatic cylinder pivotally mounted on said printer and having an extendable and retractable first shaft thereof having a first shaft distal end, said vacuum-intake structure being mounted on said first shaft distal end with the vacuum-intake structure positioned at said open-end feed location when said first shaft is in a retracted state of said first pneumatic cylinder, the pivotable structure further including a second pneumatic cylinder mounted on said printer and having an extendable and retractable second shaft thereof having a second shaft distal end mounting said pivot structure and adapted to pivot said first pneumatic cylinder mounted thereon such that at-least one of extension and retraction of the second shaft by the second pneumatic cylinder is movable of said vacuum-intake structure alternately away to or away-from said open-end feed location, when said second shaft is positioned such that the vacuum-intake structure is away-from said open-end location, said first pneumatic cylinder being alternately extendable of said first shaft such that said vacuum-intake structure is movable to said grasping-bite position and retractable of the first shaft such that said vacuum-intake structure is withdrawn away-from the grasping-bite position.

6. The improvement of claim 5, includes a first switch means for detecting completed movement of said vacuum-intake structure away from said open-end feed location by said second pneumatic cylinder and for thereafter sending a first electrical signal to said computer-type means, and said computer-type means being adapted to cause said first pneumatic cylinder to extend said first pneumatic shaft sufficiently to move said vacuum-intake structure to said grasping bite when said computer-type means receives said first electrical signal from said first switch means.

7. The improvement of claim 6, including a second switch means for detecting when a microfilm jacket has vacuum-attached to said vacuum-intake structure and for thereafter sending a second electrical signal to said computer-type means, and said computer-type means being adapted to cause said second pneumatic cylinder's second shaft to pivot said first pneumatic cylinder such that said vacuum-intake structure is moved away-from said open-end feed location.

8. The improvement of claim 7, in which electrical activation of said first pneumatic cylinder by said computer causes said first shaft to extend, and in which electrical activation of said second pneumatic cylinder causes the second shaft to retract, the pivotable structure includes a first biasing spring biasing said first shaft to a normally retracted position and state, and the pivotable structure includes a second biasing spring biasing said second shaft to a normally extended position at which said vacuum-intake structure is at said open-ended feed location when the first shaft is in a retracted state.

9. The improvement of claim 8, in which said first switch is a vacuum switch by which upon attachment of a microfilm jacket to said vacuum-intake structure increase vacuum pull causes said first switch to close electrical circuit to said said first electrical signal to said computer-type means.

10. The improvement of claim 9, in which said computer-type means is programmed such that after a first predetermined time-lapse after said second switch activates said first pneumatic cylinder to extend said first shaft, said computer-type means turns-off said vacuum-producing means to thereby terminate vacuum to said vacuum-intake structure and opening thereof such that a formerly-attached microfilm jacket is thereby released and for thereafter or substantially concurrently sending a platten-roller line-feed signal to the platten-roller line-feed drive means for sufficiently advancing a grasped microfilm jacket to reach a predetermined printing position for the initiation of printing by the printer, and such that after said vacuum-producing means if turned-off or substantially concurrently therewith said computer-type means sends a signal turning-off said first pneumatic cylinder causing spring retraction of said first shaft and thereafter sends a signal turning-off said second pneumatic cylinder causing said second shaft to extend by said second spring by which said vacuum-intake structure is returned to said open-end feed location, and such that after or substantially concurrently with said computer-type means turning-off said second pneumatic cylinder, the computer-type means turns-on said vacuum-producing means thereby again providing vacuum to said vacuum-intake structure.

11. The improvement of claim 10, in which said computer-type means is programmed such that after a first predetermined time-lapse after said second switch activates said first pneumatic cylinder to extend said first shaft, said computer-type means sends a print-signal to said printer means causing said printer to print-out a predetermined message stored on said software, and thereafter sends an ejection signal to the printer means to initiate a line-feed sufficient to eject a printed microfilm jacket by causing a predetermined amount of advancement of the platten-roller.

12. The improvement of claim 11, including a stacking means for stacking printed jackets delivered thereto, and a jacket transport means for receiving a printed jacket ejected from said printer means and transporting and delivering the transported printed jacket to the stacking means, said jacket transport means and said stacking means being activated prior to said printer means ejecting a printed microfilm jacket to said jacket transport means, said stacking means and said jacket-transport means being mounted on said printer.

13. The improvement of claim 12, in which each said microfilm jacket has opposite top and bottom ends with a jacket longitudinal axis extending therebetween, and said two spaced-apart rollable elongated cylindrically-shaped members at said open-end feed location being positioned one above the other such that a forward microfilm jacket pressed thereagainst has said jacket longitudinal axis extending substantially vertical to a imaginary horizontal.

14. The improvement of claim 13, in which said first and second pneumatic cylinders and said pivotable structure are arranged and interconnected such that when said second pneumatic cylinder has moved-away the first pneumatic cylinder to a removed-position, said second pneumatic cylinder's said second shaft has a longitudinal axis thereof extending substantially coaxially with said predetermined downwardly-inclined angle of incidence of said support and guide structure of said printer and substantially coaxially with said imaginary aligned perpendicular to said grasping bite position.

15. The improvement of claim 14, in which said angle of incidence of said support and guide structure ranges between about 15 and 25 degrees.

16. The improvement of claim 15, in which said tray along said tray longitudinal axis from a rearward position to a forward position of said tray, extends angularly downwardly an a tray angle of incidence of from about 90 to about 120 degrees, and said tray having an upper surface, and said stack-backing means includes including a weighted member positioned and adapted to press forwardly by gravity feed said plurality of microfilm jackets along said and along said tray longitudinal axis toward said open-end feed-location.

17. The improvement of claim 16, in which said stacking means includes a substantially horizontally-extending platform structure having structure positioned at a delivery level receivable of at-least one microfilm jacket with the longitudinal axis of the microfilm jacket extending substantially parallel to said platform, with the platform structure being below the delivery level from said jacket transport means and being no lower than is possible for a delivered printed jacket to be substantially horizontally receivable and elevator means mounting said platform for alternately moving said elevator upwardly to said receiving level and downwardly to an elevator bottom position, and for intermittently lowering the platform structure a predetermined minor distance below a prior receiving level such that any delivered printed jacket is not blocked by a prior-received printed jacket.

18. The improvement of claim 17, in which said elevator means includes an elevator pneumatic cylinder and an elevator piston-shaft thereof, said elevator piston-shaft having a piston-shaft distal end mounting said platform, and in which when the elevator pneumatic cylinder is activated by pneumatic pressure extending the elevator piston-shaft, the platform is caused to rise to said receiving level, and including a platform switch means detectable of a microfilm jacket delivered at said delivery level, for activating an intermittent release of a predetermined amount of elevator pneumatic pressure sufficiently to lower said platform said predetermined minor distance.

19. The improvement of claim 18, including a bottom elevator switch means for detecting when said platform reaches its lowest predetermined bottom level and for turning-off said printer and said improvements when said platform reaches said lowest predetermined bottom level.

20. The improvement of any one of claims 1, 2 or 3, including a stacking means for stacking printed jackets delivered thereto, and a jacket transport means for receiving a printed jacket ejected from said printer means and transporting and delivering the transported printed jacket to the stacking means, said jacket transport means and said stacking means being activated prior to said printer means ejecting a printed microfilm jacket to said jacket transport means, said stacking means and said jacket-transport means being mounted on said printer.

21. The improvement of any one of claims 1, 2 or 3, in which each said microfilm jacket has opposite top and bottom ends with a jacket longitudinal axis extending therebetween, and said two spaced-apart rollable elongated cylindrically-shaped members at said open-end feed location being positioned one above the other such that a forward microfilm jacket pressed thereagainst has said jacket longitudinal axis extending substantially vertical to an imaginary horizontal.

22. The improvement of any one of claims 1, 2 or 3, in which said take-off jacket-feed means further includes pivotable structure, with the vacuum-intake structure mounted on said transported by movement of the pivotable structure to and from and between said open-end feed location and said grasping-bite position, said pivotable structure being driven in its movement by said feed-transport means, in which said pivotable structure includes a first pneumatic cylinder pivotally mounted on said printer and having an extendable and retractable first shaft thereof having a first shaft distal end, said vacuum-intake structure positioned at said open-end feed location when said first shaft is in a retracted state of said first pneumatic cylinder, the pivotable structure further including a second pneumatic cylinder, mounted on said printer and having an extendable and retractable second shaft thereof having a second shaft distal end mounting said pivot structure and adapted to pivot said first pneumatic cylinder mounted thereon such that at-least one of extension and retraction of the second shaft by the second pneumatic cylinder is movable of said vacuum-intake structure alternately away to or away-from said open-end feed location, when said second shaft is positioned such that the vacuum-intake structure is away-from said open-end location, said first pneumatic cylinder being alternately extendable of said first shaft such that said vacuum-intake structure is movable to said grasping-bite position and retractable of the first shaft such that said vacuum-intake structure is withdrawn away-from the grasping-bite position, and in which said first and second pneumatic cylinders and said pivotable structure are arranged and interconnected such that when said second pneumatic cylinder has moved-away the the first pneumatic cylinder to a removed-position, said second pneumatic cylinder's said second shaft has a longitudinal axis thereof extending substantially coaxially with said predetermined downwardly-inclined angle of incidence of said support and guide structure of said printer and substantially coaxially with said imaginary aligned perpendicular to said grasping bite position.

23. The improvement of any one of claims 1, 2 or 3, in which said angle of incidence of said support and guide structure ranges between about 155 and 170 degrees.

24. The improvement of any one of claims 1, 2 or 3, in which said tray along said tray longitudinal axis from a rearward position to a forward position of said tray, extends angularly downwardly an a tray angle of incidence of from about 110 to about 130 degrees, and said tray having an upper surface, and said stack-backing means includes including a weighed member positioned and adapted to press forwardly by gravity feed said plurality of microfilm jackets along said upper surface and along said tray longitudinal axis toward said open-end feed-location.

25. The improvement of claim 20, in which said stacking means includes a substantially horizontally-extending platform structure having structure positioned at a delivery level receivable of at-least one microfilm jacket with the longitudinal axis of the microfilm jacket extending substantially parallel to said platform, with the platform structure being below the delivery level from said jacket transport means and being no longer than is possible for a delivered printed jacket to be substantially horizontally receivable, and elevator means mounting said platform for alternately moving said elevator upwardly to said receiving level and downwardly to an elevator bottom position, and for intermittently lowering the platform structure a predetermined minor distance below a prior receiving level such that any delivered printed jacket is not blocked by a prior-received printed jacket.

26. The improvement of claim 25, in which said elevator means includes an elevator pneumatic cylinder and an elevator piston-shaft thereof, said elevator piston-shaft having a piston-shaft distal end mounting said platform, and in which when the elevator pneumatic cylinder is activated by pneumatic pressure extending the elevator piston-shaft, the platform is caused to rise to said receiving level, and including a platform switch means detectable of a microfilm jacket delivered at said delivery level, for activating an intermittent release of a predetermined amount of elevator pneumatic pressure sufficiently to lower said platform said predetermined minor distance.

27. The improvement of claim 26, including a bottom elevator switch means for detecting when said platform reaches its lowest predetermined bottom level and for turning-off said printer and said improvements when said platform reaches said lowest predetermined bottom level.

* * * * *